US008986622B2

(12) United States Patent
Koseoglu et al.

(10) Patent No.: US 8,986,622 B2
(45) Date of Patent: Mar. 24, 2015

(54) APPARATUS FOR UPGRADING WHOLE CRUDE OIL TO REMOVE NITROGEN AND SULFUR COMPOUNDS

(75) Inventors: Omer Refa Koseoglu, Dhahran (SA); Adnan Al-Hajji, Dammam (SA); Hendrik Muller, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 208 days.

(21) Appl. No.: 12/658,660

(22) Filed: Feb. 9, 2010

(65) Prior Publication Data

US 2010/0147647 A1 Jun. 17, 2010

Related U.S. Application Data

(62) Division of application No. 11/985,533, filed on Nov. 14, 2007, now Pat. No. 7,799,211.

(51) Int. Cl.

| | |
|---|---|
| ***C10G 25/11*** | (2006.01) |
| ***C10G 7/06*** | (2006.01) |
| ***C10G 7/00*** | (2006.01) |
| ***C10G 25/00*** | (2006.01) |
| ***C10G 25/05*** | (2006.01) |
| ***C10G 25/12*** | (2006.01) |

(52) U.S. Cl.

CPC *C10G 25/11* (2013.01); *C10G 7/06* (2013.01); *C10G 7/00* (2013.01); *C10G 25/003* (2013.01); *C10G 25/05* (2013.01); *C10G 25/12* (2013.01); *C10G 2300/202* (2013.01); *C10G 2300/205* (2013.01)

USPC ..... 422/261; 196/46; 208/302; 208/305

(58) Field of Classification Search

USPC ..... 208/300, 302, 304, 305, 310 R, 347, 208/364; 422/211, 213, 215, 261; 196/46

See application file for complete search history.

(56) References Cited

U.S. PATENT DOCUMENTS

| | | | | |
|---|---|---|---|---|
| 1,788,654 | A * | 1/1931 | Baylis | 208/302 |
| 3,315,003 | A | 4/1967 | Khelghatian | |
| 3,996,130 | A | 12/1976 | Nametkin | |
| 4,119,530 | A | 10/1978 | Czajkowski | |
| 4,172,842 | A | 10/1979 | Schlinger | |
| 4,391,677 | A | 7/1983 | Harris | |

(Continued)

OTHER PUBLICATIONS

Maples, Robert E., Petroleum Refinery Process Economics, 2nd Ed., 2000, Chapter 7: Crude Oil Processing (pp. 89-97).*

(Continued)

*Primary Examiner* — Renee E Robinson

(74) *Attorney, Agent, or Firm* — Abelman, Frayne & Schwab

(57) ABSTRACT

A crude oil feedstream is treated to remove or reduce the content of known undesired heteroatomic and polynuclear aromatic compounds containing nitrogen and sulfur by contacting the feedstream with one or more solid adsorbent materials selected from attapulgus clay, alumina, silica gel and activated carbon in a mixing vessel for a time that is sufficient to optimize the adsorption of the undesired compounds from the crude oil, subjecting the mixture to atmospheric flash distillation and then to vacuum flash distillation to recover presorbed boiling ranges of products having a lowered content of the undesired compounds, and preferably regenerating at least a portion of the solid adsorbent material for reuse in the process.

13 Claims, 1 Drawing Sheet

(56) References Cited

U.S. PATENT DOCUMENTS

| | | | | |
|---|---|---|---|---|
| 4,468,316 | A | 8/1984 | Swanson | |
| 4,770,764 | A * | 9/1988 | Ohtake et al. | 208/73 |
| 4,804,457 | A * | 2/1989 | Ngan | 208/64 |
| 4,831,207 | A | 5/1989 | O'Keefe | |
| 4,831,208 | A | 5/1989 | Zarchy | |
| 4,835,338 | A | 5/1989 | Liu | |
| 4,836,993 | A | 6/1989 | Bertolacini | |
| 4,846,962 | A | 7/1989 | Yao | |
| 4,894,141 | A | 1/1990 | Busch | |
| 4,904,347 | A | 2/1990 | Cros | |
| 4,944,862 | A | 7/1990 | Chen | |
| 5,843,300 | A | 12/1998 | Zinnen | |
| 6,245,223 | B1 * | 6/2001 | Gorbaty et al. | 208/251 R |
| 6,248,230 | B1 | 6/2001 | Min | |
| 6,352,638 | B2 | 3/2002 | Jacobson | |
| 6,406,616 | B1 | 6/2002 | Rappas | |
| 7,144,498 | B2 | 12/2006 | McCall | |
| 2001/0045377 | A1 | 11/2001 | Morishima | |
| 2003/0089638 | A1 | 5/2003 | Gueret | |
| 2005/0143612 | A1 | 6/2005 | Hwang | |
| 2006/0211906 | A1 | 9/2006 | Berezutskiy | |

OTHER PUBLICATIONS

International Search Report and Written Opinion, PCT/US/2008/012629, pp. 1-6.

* cited by examiner

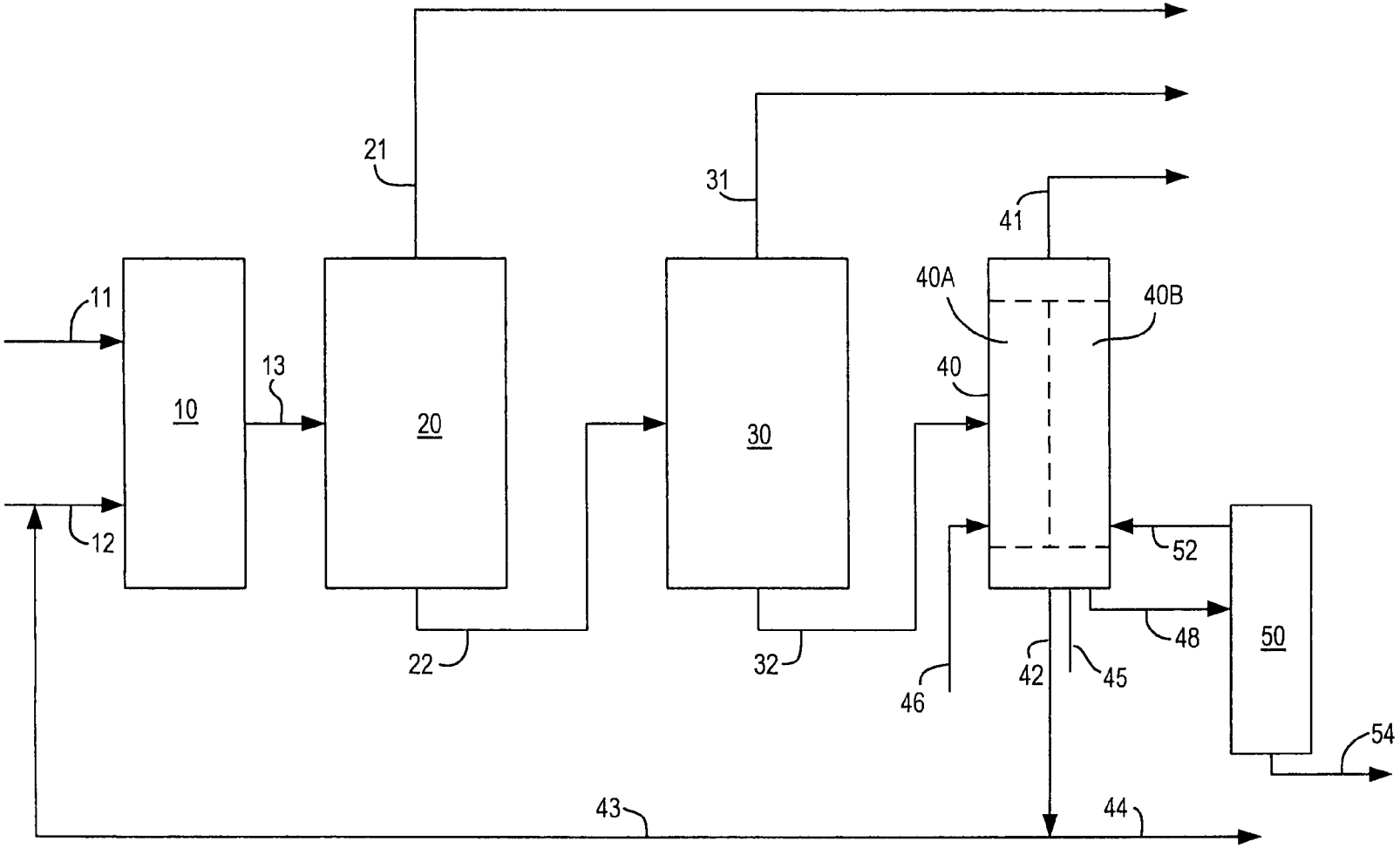
10
11
12
13
20
21
22
30
31
32
40
40A
40B
41
42
43
44
45
46
48
50
52
54

APPARATUS FOR UPGRADING WHOLE CRUDE OIL TO REMOVE NITROGEN AND SULFUR COMPOUNDS

RELATED APPLICATION

This application is a division of U.S. Ser. No. 11/985,533 filed Nov.14, 2007, now U.S. Pat. No. 7,799,211 and which has been allowed.

FIELD OF THE INVENTION

This invention relates to the treatment of a whole crude oil feedstream to remove undesired compounds in order to upgrade the treated crude oil and thereby enhance and render more efficient the downstream processing of the treated stream.

BACKGROUND OF THE INVENTION

Crude oil extracted from reservoir rock contain a number of undesired compounds, or contaminants. Reduction in the amount of sulfur compounds in automotive fuels and other refined hydrocarbons are required in order to meet environment concerns and regulations. These contaminants also adversely impact refinery operations, e.g., by poisoning catalysts.

Crude oils contain heteroatoms such as sulfur, nitrogen, nickel, vanadium and others in quantities that impact the refinery processing of the crude oils fractions. Light crude oils or codensates contain in concentrations as low as 0.01 W %. In contrast, heavy crude oils contain as much as 5-6 W %. The nitrogen content of crude oils can range from 0.001-1.0 W %. The heteroatom contents of typical Arabian crude oils are listed in Table 1 from which it can be seen that the heteroatom content of the crude oils within the same family increases with decreasing API gravity, or increasing heaviness.

TABLE 1

| Property | ASL | AEL | AL | AM | AH |
|---|---|---|---|---|---|
| Gravity, ° | 51.4 | 39.5 | 33.0 | 31.1 | 27.6 |
| Sulfur, W % | 0.05 | 1.07 | 1.83 | 2.42 | 2.94 |
| Nitrogen, ppmw | 70 | 446 | 1064 | 1417 | 1651 |
| RCR, W % | 0.51 | 1.72 | 3.87 | 5.27 | 7.62 |
| Ni + V, ppmw | <0.1 | 2.9 | 21 | 34.0 | 67 |

The following abbreviations are used in Table 1:
ASL - Arab Super Light;
AEL - Arab Extra Light:
AL - Arab Light;
AM - Arab Medium and
AH - Arab Heavy;
W % is percent by weight;
ppmw is parts per million by weight.

The heteroatom content of the crude oil fractions also increases with increasing boiling point and representative data is provided in Table 2.

TABLE 2

| Fractions, ° C. | Sulfur WT % | Nitrogen ppmw |
|---|---|---|
| C5-90 | 0.01 | |
| 93-160 | 0.03 | |
| 160-204 | 0.06 | |
| 204-260 | 0.34 | |
| 260-315 | 1.11 | |

TABLE 2-continued

| Fractions, ° C. | Sulfur WT % | Nitrogen ppmw |
|---|---|---|
| 315-370 | 2.00 | 253 |
| 370-430 | 2.06 | 412 |
| 430-482 | 2.65 | 848 |
| 482-570 | 3.09 | 1337 |

These impurities must be removed during the refining operations to meet the environmental regulations for the final products (e.g., gasoline, diesel, fuel oil) or for the intermediate refining streams that need to be processed for further upgrading, such as reforming isomerization.

In a typical petroleum refinery, crude oil is first fractionated in an atmospheric distillation column to separate and recover sour gas and light hydrocarbons, including methane, ethane, propane, butanes and hydrogen sulfide, naphtha (36-180° C.), kerosene (180-240° C.), gas oil (240-370° C.), and atmospheric residue, which is the remaining hydrocarbon fraction boiling above 370° C. The atmospheric residue from the atmospheric distillation column is typically used either as fuel oil or sent to a vacuum distillation unit, depending on the configuration of the refinery. The principal products of vacuum distillation are vacuum gas oil, being hydrocarbons boiling in the range 370-520° C., and vacuum residue consisting of hydrocarbons boiling above 520° C.

Contaminants such as sulfur, nitrogen and polynuclear aromatics in the crude oil fractions impact these downstream processes, and others, including hydrotreating, hydrocracking and FCC. These contaminants are present in the crude oil fractions in varying structures and concentrations.

Naphtha, kerosene and gas oil streams derived from crude oils or from other natural sources such as shale oils, bitumens and tar sands, are treated to remove the contaminants, e.g., mainly sulfur, whose quantity exceeds the specifications. Hydrotreating is the most common refining process technology employed to remove the contaminants. Vacuum gas oil is typically processed in a hydrocracking unit to produce gasoline and diesel or in a fluid catalytic cracking unit to produce gasoline, with LCO and HCO as by-products. The LCO is typically used either as a blending component in a diesel pool or as fuel oil, while the HCO is typically sent directly to the fuel oil pool. There are several processing options for the vacuum residue fraction, including hydroprocessing, coking, visbreaking, gasification and solvent deasphalting.

Processes have been disclosed employing solid adsorbent materials for use in treating hydrocarbon feedstreams to remove undesired compounds, including nitrogen and sulfur-containing compounds. For example, U.S. Pat. No. 4,846,962 discloses a process for selectively removing basic nitrogen compounds from solvent extracted oils by their absorption on a solid acidic polar-adsorbent material. Following the solvent extraction process, the basic nitrogen compounds present with the desired oil fraction are contacted with adsorbents of the silica-alumina type, Ketjen high-alumina base (amorphous) and H—Y zeolite (crystalline) identified as being preferred. In addition, various treatments were applied to the adsorbents to improve their effectiveness. It was also disclosed that the adsorbents could be regenerated, e.g., by purging with a hot hydrogen gas stream.

In the process described in U.S. Pat. No. 5,843,300, organic sulfur compounds, especially aromatic sulfur compounds, are removed from an FCC feedstream with minimal adsorption of aromatic hydrocarbons using a zeolite X exchanged with alkali or alkaline earth cations, with KX being an especially effective adsorbent. It was also indicated that the adsorbent could be regenerated by contact with a heated stream of hydrogen. The use of the process in treating FCC feedstocks having particular classes of sulfur-containing materials was disclosed as particularly effective.

A process is disclosed in U.S. Pat. No. 6,248,230 for improving the efficiency of hydrodesulfurization processes by first extracting natural polar compounds from a distillate feedstream. The improvement was based upon the stated finding that even small quantities of natural polar compounds have a significant negative effect upon the hydrodesulfurization process in the deep desulfurization zone. The natural polar compounds includes nitrogen and sulfur-containing compounds having a relatively higher polarity than that of dibenzothiophene. Adsorbents include activated alumina, acid white clay, Fuller's earth, activated carbon, zeolite, hydrated alumina, silica gel, ion exchange resin, and their combinations. In the process disclosed, the treated feedstream is catalytically hydroprocessed to produce a hydrocarbon fuel.

Removal of contaminants depends on their molecular characteristics; therefore, detailed knowledge of the sulfur species in the feedstock and products is important for the optimization of any desulfurization process. Numerous analytical tools have been employed for sulfur compounds speciation. Gas chromatography (GC) with sulfur-specific detectors is routinely applied for crude oil fractions boiling up to 370° C. The use of ultra-high resolution Fourier transform ion cyclotron resonance (FT-ICR) mass spectrometry has recently been advanced as a powerful technique for the analysis of heavy petroleum fractions and whole crude oils. Use of this methodology is described in (1) Choudhary, T. V. Malandra, J., Green J., Parrott, S., Johnson, B., *Angew. Chem., Int. Ed.* 2006, 45, 3299-3303; (2) Hughey, C. A., Rodgers, R. P., Marshall, A. G., *Anal. Chem.* 2002, 74, 4145-4149; and (3) Müller, H., Schrader, W., Andersson, J. T., *Anal. Chem.,* 2005; 77, 2536-2543.

Two ionization analytical methods that have been successfully employed in the analysis for aromatic sulfur and polar nitrogen petroleum components are electrospray ionization (EST) and atmospheric pressure photo ionization (APPI). Both are well known analytical methods and the apparatus for their practice are commercially available.

From the above discussion, it is apparent that it would be desirable to upgrade crude oil by removing specific undesirable compounds at an early stage of processing so that the fractions subsequently recovered are free of these compounds.

It is therefore a principal object of the present invention to provide a novel method of treating crude oil to substantially reduce the content of undesired sulfur and nitrogen compounds.

Another object of the invention is to provide a method of removing undesired sulfur and nitrogen compounds from crude oil that requires a relatively low capital investment for equipment and that is economical to operate.

SUMMARY OF THE INVENTION

The above objects and other advantages are achieved by the process of the present invention for upgrading crude oil to reduce the content of specified undesired heteroatomic compounds and polynuclear aromatic (PNA) compounds containing sulfur and nitrogen that comprises:

a. mixing the crude oil with a solid adsorbent material that is an absorbent for the specified heteroatomic and polynuclear compounds for a sufficient time and under conditions so that the undesired compounds are adsorbed;

b. subjecting the crude oil mixture containing the solid adsorbent material to atmospheric flash distillation, and separating and removing the distillates having an initial boiling point of 36° C. and a final boiling point between 350° C. and 400° C.;

c. transferring the bottoms from the atmospheric distillation of step (b) to a vacuum distillation vessel and subjecting the mixture to vacuum flash distillation, and separating and removing the distillates having an initial boiling point between 350° C. and 480° C. and a final boiling point between 480° C. and 560° C.;

d. regenerating the adsorbent material contained in the bottoms from the vacuum distillation vessel; and e. recovering and returning regenerated adsorbent material for re-use in step (a).

As used herein, the term "crude oil" will be understood to include whole crude oil from conventional sources, and hydrocarbons recovered from oils sands or shale oil, which contain high concentrations of nitrogen and PNA molecules.

The nitrogen, sulfur and polynuclear aromatic compound contaminants are selectively removed from the crude oil using solid particles which preferably have a surface area of at least 100 $m^2/g$, a pore size of at least 10 Angstroms and a pore volume of 0.1 cc/g.

The use of the process to pretreat crude oil in the field or in a refinery before it is refined to remove contaminants will increase the efficiency of the downstream refining processes. The process pretreats the crude oil by contacting the oil with one or more solid adsorbents. The contaminants that are detrimental to the downstream refining processes are pre-separated which increases the overall efficiency of the processing units.

The preferred adsorbents are attapulgus clay, alumina, silica gel and activated carbon, the relevant properties of which are given below.

TABLE 3

| Property | Units | Activated Carbon | Attapulgus Clay | Silica Gel |
|---|---|---|---|---|
| Surface Area | $M^2/g$ | 770 | 108 | 424 |
| Pore Size | ° A | 12.7 | 146 | 17.4 |
| Pore Size Distribution | ° A-cc/g | 46.4 | 97.1 | 176.3 |
| Pore Volume | cc/g | 0.442 | 0.392 | 0.368 |

The adsorbent can be regenerated using solvents varying in polarity according to the Hildebrand solubility parameter, which is a well-known measure of polarity and has been tabulated for numerous compounds. See, for example, *Journal of Paint Technology, vol.* 39, no. 505 (February 1967).

The majority of the regenerated solid adsorbent material (90-95 W %) can be recycled back to the contacting vessel and the remainder of the adsorbent material (approximately 5-10%) is disposed of as waste. Fresh adsorbent material is continuously added at a predetermined rate and a comparable proportion of used solid adsorbent material is withdrawn for disposal, either before or after the regeneration step. The efficiency of the process is monitored and a decision is made to replace all, or a larger proportion of the used adsorbent material that has accumulated metals and other particulate matter in its pores to an extent that the process is not performing satisfactorily.

BRIEF DESCRIPTION OF THE DRAWING

The process of the invention will be further described below and with reference to the schematic drawing which is attached.

DETAILED DESCRIPTION OF THE PREFERRED EMBODIMENTS

Referring now to the drawing, there is schematically illustrated an embodiment suitable for practicing the invention that includes five vessels that are functionally described as contacting vessel 10, atmospheric flash separator vessel 20, vacuum flash separator vessel 30, filtration/regeneration vessel 40, and solvent treatment vessel 50.

In a particularly preferred embodiment, all of the vessels are operated as components in a continuous process. The crude oil feedstream 11 and the solid adsorbent 12 are fed to the contacting vessel 10 and mixed to form a slurry. The contacting vessel 10 can be operated as an ebullient bed or fixed-bed reactor, a tubular reactor or a continuous stirred-tank reactor.

The solid adsorbent/crude oil slurry mixture 13 is then transferred to the atmospheric flash separator 20 to separate and recover the atmospheric distillates 21. The atmospheric residue bottoms stream 22 from vessel 20 is sent to the vacuum flash separator vessel 30. The vacuum distillates stream 31 is withdrawn from the top of vessel 30 and the bottoms 32 containing the vacuum flash residue and solid adsorbent are sent to the solvent adsorbent regeneration unit vessel 40. The vacuum residue product 41 is withdrawn from the top of vessel 40 and the bottoms 42 are removed and separated so that the reusable regenerated adsorbents 43 are recycled back and introduced with fresh feed 12 into vessel 10; the unused portion 44 of the regenerated adsorbent is removed for disposal.

In a particularly preferred embodiment, the adsorbent regeneration unit 40 is operated in swing mode so that production of the regenerated absorbent is continuous. When the adsorbent material in stream 32 from vacuum distillation unit 30 that is introduced into one regeneration unit, e.g., 40A, reaches capacity, the flow of feedstream 32 is then directed to the other column 40B. The adsorbed compounds are desorbed by heat or solvent treatment. The nitrogen and PNA-containing adsorbed compounds can be desorbed by either applying heat with an inert nitrogen gas flow at the pressure of 1-10 $Kg/cm^2$ or by desorption with an available fresh or recycled solvent stream 46 or 52, or a refinery stream, such as naphtha, diesel, toluene, acetone, methylene chloride, xylene, benzene or tetrahydrofuran in the temperature range of from 20° C. to 250° C.

In the case of heat desorption, the desorbed compounds are removed from the bottom of the column as stream 48 for use in other refinery processes, such as residue upgrading facilities, including hydroprocessing, coking, the asphalt plant, or is used directly in fuel oil blending.

Solvents are selected based on their Hildebrand solubility factors or by their two-dimensional solubility factors. The overall Hildebrand solubility parameter is a well-known measure of polarity and has been calculated for numerous compounds. See, for example, *Journal of Paint Technology, vol.* 39, no. 505 (February 1967). Appropriate solvents can also be described by their two-dimensional solubility parameter comprised of the complexing solubility parameter and the field force solubility parameter. See, for example, I. A. Wiehe, *Ind. & Eng. Res.,* 34 (1995), 661. The complexing solubility parameter component, which describes the hydrogen bonding and electron donor-acceptor interactions, measures the interaction energy that requires a specific orientation between an atom of one molecule and a second atom of a different molecule. The field force solubility parameter, which describes the van der Waals and dipole interactions, measures the interaction energy of the liquid that is not destroyed by changes in the orientation of the molecules.

In accordance with this invention the non-polar solvent, or solvents, if more than one is employed, preferably have an overall Hildebrand solubility parameter of less than about 8.0 or the complexing solubility parameter of less than 0.5 and a field force parameter of less than 7.5. Suitable non-polar solvents include, e.g., saturated aliphatic hydrocarbons such as pentanes, hexanes, heptanes, parafinic naphthas, $C_5$-$C_{11}$, kerosene $C_{12}$-$C_{15}$, diesel $C_{16}$-$C_{20}$, normal and branched paraffins, mixtures of any of these solvents. The preferred solvents are $C_5$-$C_7$ paraffins and $C_5$-$C_{11}$ parafinic naphthas.

In accordance with this invention, the polar solvent(s) have an overall solubility parameter greater than about 8.5 or a complexing solubility parameter of greater than 1 and field force parameter of greater than 8. Examples of polar solvents meeting the desired minimum solubility parameter are toluene (8.91), benzene (9.15), xylenes (8.85), and tetrahydrofuran (9.52). The preferred polar solvents used in the examples that follow are toluene and tetrahydrofuran.

In the case of solvent desorption, the solvent and rejected stream from the adsorbent tower is sent to a fractionation unit 50 within the battery limits. The recovered solvent stream 52 is recycled back to the adsorbent regeneration unit 40, or 40A and 40B, for reuse. The bottoms stream 54 from fractionation unit 50 can be sent to other refinery processes.

This invention utilizes solid particles to remove predetermined contaminants from the crude oil feedstream. The process is not complex, and the equipment requirements are conventional and can be installed in an oil production field or in refineries as a pretreatment process.

EXAMPLE

A heavy oil containing 84.6 W % carbon, 12 W % of hydrogen. 3.27 W % sulfur and 0.25 W % nitrogen was contacted with attapulgus clay in a vessel simulating a slurry column at 40° C. for 30 minutes. The slurry mixture was then filtered and the solid mixture was washed with a straight run naphtha stream boiling in the range 36-180° C. containing 97 W % paraffins, the rest being aromatics and naphtenes at 1:5 V:V % oil-to-solvent ratio. After fractionation of the naphtha stream, 90.5 W % of the product was collected. The adsorbent-treated product contained 12.19 W % hydrogen (1.9% increase), 3.00 W % sulfur (8 W % decrease) and 1445 ppmw nitrogen (42 W % decrease). The adsorbent was further washed with toluene and tetrahydrofuran at 1:5 V:V % solid-to-solvent ratio and 7.2 W % and 2.3 W %, respectively, of reject fractions were obtained. The material balance of the upgrading process and the elemental compositions for the feed stock and products are reported in Table 3.

TABLE 3

| Fraction | Mass W % | C W % | H W % | S W % | N W % |
|---|---|---|---|---|---|
| Crude Oil | 100.0 | 84.6 | 12.0 | 3.27 | 0.250 |
| Upgraded Crude Oil | 90.5 | 84.7 | 12.2 | 3.00 | 0.145 |
| Residue | 9.5 | 84.2 | 10.0 | 5.05 | 0.677 |
| Material Balance | 100.0 | 100.1 | 100.2 | 98.5 | 78.15 |

A custom-built FT-ICR ultra high resolution mass spectrometer, equipped with a 9.4 Tesla superconducting magnet was used to characterize the crude oil and the upgraded products. The observed masses in the spectra of feedstock and product range from 200 up to 800 Daltons for the three ionization modes employed. Neutral species, i.e., aromatic hydrocarbons and sulfur aromatic species were detected using the APPI ionization mode. Polar nitrogen and oxygen species were ionized by electrospray in the positive and negative mode, respectively.

Aromatic hydrocarbon, sulfur, nitrogen, and oxygen species are all identified in both feedstock and product. Mono-, di- and tri-sulfur species with a high degree of aromatic character, i.e., five to seven condensed aromatic rings, are found in the feedstock, but are readily removed by the upgrading treatment. Molecules with fewer than five condensed aromatic rings are proportionally increased as a result of the upgrading process of the invention.

This invention utilizes solid adsorbents to selectively remove compounds from crude oil that can poison catalysts in downstream catalytic processing units. The solid particles are selected for use in the process to have sufficient surface area, pore volume and pore size to adsorb the poisonous compounds.

The process of the invention and its advantages have been described in detail and illustrated by example. However, as will be apparent to one of ordinary skill in the art from this description, further modifications can be made and the full scope of this invention is to be determined by the claims that follow.

We claim:

1. An apparatus for treating a crude oil feedstream to reduce the content of undesired components, the apparatus comprising:

a. a source of a crude oil feedstream containing undesired components;

b. a source of solid adsorbent material particles including fresh solid porous adsorbent material particles;

c. a mixing vessel in fluid communication with the source of crude oil and the source of adsorbent material particles and for mixing the crude oil and adsorbent material particles to form a slurry;

d. an atmospheric flash distillation vessel in direct fluid communication with the mixing vessel for receiving the slurry, and having a distillate outlet for discharging product within a first prescribed temperature range and a bottoms outlet for discharging the solid adsorbent material particles and bottoms from atmospheric distillation;

e. a vacuum distillation vessel in fluid communication with the atmospheric distillation vessel for receiving the solid adsorbent material particles and bottoms from the atmospheric distillation vessel, and having a distillate outlet for discharging product within a second prescribed temperature range and a bottoms outlet for discharging a mixture of vacuum residue and solid adsorbent material particles;

f. an adsorbent regeneration vessel in fluid communication with the vacuum distillation vessel for receiving the mixture of vacuum residue and solid adsorbent material particles, and having a vacuum residue outlet and a bottoms outlet constructed and arranged for discharging and recycling at least a portion of regenerated splid absorbent material particles to the mixing vessel; and g. a transfer line between the bottoms outlet of the adsorbent regeneration vessel and source of solid adsorbent material particles or the mixing vessel.

2. The apparatus of claim 1 in which the adsorbent regeneration vessel is in fluid communication with a source of liquid solvent for the undesired components.

3. The apparatus of claim 2 that includes a solvent regeneration vessel in fluid communication with the adsorbent regeneration vessel.

4. The apparatus of claim 1 in which the mixing vessel is selected from the group consisting of a stirred-tank, an ebullient-bed reactor, a fixed bed reactor and a tubular reactor.

5. The apparatus of claim 1, further wherein the adsorbent regeneration vessel is in fluid communication with a source of heated inert nitrogen for heat desorption.

6. The apparatus of claim 1, further wherein the adsorbent regeneration vessel is in fluid communication with a source of solvent for solvent desorption.

7. The apparatus of claim 6, wherein the source of solvent contains a plurality of solvents having varying polarity and are selected for the regeneration based on their Hildebrand solubility.

8. The apparatus of claim 6, wherein the source of solvent contains one or more solvents selected from the group consisting of saturated aliphatic hydrocarbons, pentanes, hexanes, heptanes, paraffinic naphthas, kerosene, diesel and C5-C7 paraffins.

9. The apparatus of claim 6, wherein the source of solvent contains a one or more solvents selected from the group consisting of toluene, benzene, xylenes, and tetrahydrofuran.

10. The apparatus of claim 1 in which the solid adsorbent material particles comprise attapulgus clay particles.

11. The apparatus of claim 1 in which the solid adsorbent material particles comprise alumina particles.

12. The apparatus of claim 1 in which the solid adsorbent material particles comprise silica gel particles.

13. The apparatus of claim 1 in which the solid adsorbent material particles comprise activated carbon particles.

* * * * *